US006853119B2

(12) United States Patent
Huntington et al.

(10) Patent No.: US 6,853,119 B2
(45) Date of Patent: Feb. 8, 2005

(54) DOUBLE LAYER ELECTRODE COIL FOR A HID LAMP AND METHOD OF MAKING THE ELECTRODE COIL

(75) Inventors: Charles A. Huntington, Boothbay Harbor, ME (US); Stuart K. Denham, Waldoboro, ME (US)

(73) Assignee: Osram Sylvania Inc., Danvers, MA (US)

( * ) Notice: Subject to any disclaimer, the term of this patent is extended or adjusted under 35 U.S.C. 154(b) by 218 days.

(21) Appl. No.: 09/921,039

(22) Filed: Aug. 2, 2001

(65) Prior Publication Data

US 2003/0025434 A1 Feb. 6, 2003

(51) Int. Cl.[7] ..... H01J 1/16; H01J 19/10

(52) U.S. Cl. ..... 313/344; 313/331; 313/341; 313/243; 313/343

(58) Field of Search ..... 313/331, 341–344, 313/243

(56) References Cited

U.S. PATENT DOCUMENTS

| | | | | |
|---|---|---|---|---|
| 2,523,033 A | | 9/1950 | Leighton | 176/16 |
| 4,052,634 A | * | 10/1977 | De Kok | 313/630 |
| 4,105,908 A | | 8/1978 | Harding et al. | 313/217 |
| 4,136,227 A | * | 1/1979 | Saito et al. | 428/389 |
| 4,334,628 A | * | 6/1982 | Buhrer et al. | 220/2.1 R |

FOREIGN PATENT DOCUMENTS

| | | | | |
|---|---|---|---|---|
| EP | 0 579 429 A1 | | 1/1994 | H01J/61/073 |
| EP | 1 094 497 A2 | | 4/2001 | H01J/61/073 |
| JP | 50-85181 | | 7/1975 | H01J/61/04 |
| JP | 50085181 A | * | 7/1975 | H01J/61/07 |
| JP | 56041666 A | * | 4/1981 | H01J/61/06 |
| JP | 59171447 A | * | 9/1984 | H01J/61/073 |
| JP | 2002083538 A | * | 3/2002 | H01J/9/04 |

OTHER PUBLICATIONS

Abstract, JP 10092377 (Apr. 10, 1998).

* cited by examiner

*Primary Examiner*—Vip Patel
*Assistant Examiner*—Anthony Perry
(74) *Attorney, Agent, or Firm*—Robert F. Clark

(57) ABSTRACT

A double-layer electrode coil for a high intensity discharge (HID) lamp and a method of making the electrode coil are provided. A more stable layer of coils is made by front winding, instead of back winding, the layers of wire. The second layer of wire is entirely within a helical groove on the exterior surface of the first layer of wire. This arrangement is particularly stable and permits more rapid insertion of the electrode shank after removal of the mandrel.

5 Claims, 4 Drawing Sheets

DOUBLE LAYER ELECTRODE COIL FOR A HID LAMP AND METHOD OF MAKING THE ELECTRODE COIL

BACKGROUND OF THE INVENTION

The present invention is directed to an electrode coil for a high intensity discharge (HID) lamp and to a method of making an electrode coil for a HID lamp.

As shown in FIG. 1, a conventional HID lamp includes a tube 10 with two electrode coils 12 therein that are typically placed at opposing ends of tube 10. Tube 10 is filled with an appropriate gas and fill material, and sealed. Each electrode coil 12 includes a tungsten shank 14 with a tungsten wire coil 16 adjacent to a free end of tungsten shank 14 inside tube 10.

Electrode coil 12 has been conventionally made with a coiled coil or by back winding tungsten wire to form a second layer of wire wound in a direction opposite to the winding direction of the first layer. These manufacturing methods have not proven entirely satisfactory.

The coiled coil method includes the steps of winding a primary tungsten wire around a primary tungsten mandrel and then winding the coiled wire and primary mandrel around a secondary molybdenum mandrel. The coiled coil is heat-treated, cut to length, and heat-treated again. The secondary molybdenum mandrel is dissolved in acid and replaced with a tungsten shank. An example of a coiled coil electrode coil is shown in FIG. 2.

The coiled coil method is generally cost effective because the manufacturing equipment is largely automated. However, the insertion of the tungsten shank can cause the primary tungsten mandrel to crack, which is a basis for rejecting the electrode coil.

The back winding method includes the step of winding a tungsten wire around a retractable steel pin. After a predetermined number of turns or distance, the winding direction is reversed (for example, from left-to-right to right-to-left) and the wire is wound back over itself to form a second layer. Subsequently, several turns of the first layer may be left exposed, the steel pin removed, the coil oriented properly, and the tungsten shank inserted. An example of a back wound electrode coil is shown in FIG. 3.

Although the back winding method produces fewer problems than the coiled coil method when the tungsten shank is inserted, the back wound coil does not hold its shape well. Moreover, the process is more labor intensive as the asymmetrical coil must be oriented properly on the tungsten shank. The orientation of the coil takes additional time and these machines quickly reach capacity limits.

U.S. Pat. No. 4,105,908 discloses a back wound coiled coil electrode. A coil wrapped around a primary mandrel is wrapped around a secondary mandrel and back wound over itself to form a two-layer coiled coil, such as shown in FIG. 4. However, manufacture of this electrode coil enjoys the problems of both the above-noted methods.

U.S. Pat. No. 2,523,033 is not related to the manufacture of electrode coils, but is of general interest because it discloses a double layer coil in a lamp. The lamp includes a filament that expands and contracts axially during use. A spring portion of the filament absorbs the stress of elongation and contraction. As shown in FIG. 5, an in-lead 18 for the spring is thicker than filament 20 and is connected to filament 20 by butt-welding 22 the ends of the small diameter filament 20 to the large diameter in-lead 18. A first layer of wire 24 is wound around filament 20. The wire 24 has a diameter equal to the difference between the radii of filament 20 and in-lead 18. A second layer of wire 26 is screwed onto first layer 24 and onto in-lead 18. The combination of first and second layers of wire 24 and 26 reinforces butt-weld 22 by absorbing some of the mechanical strain.

SUMMARY OF THE INVENTION

An object of the present invention is to provide a novel method of making an electrode coil for a HID lamp that avoids the problems of the prior art, specifically the problem of orienting the coil for insertion of the tungsten shank.

A further object of the present invention is to provide a novel method of making an electrode coil for a HID lamp in which two overlapping wires are wrapped in the same direction on a mandrel so that the second wire is entirely within a helical groove on an exterior of the first wire and in which the two coils formed by the first and second wires are generally the same length.

A yet further object of the present invention is to provide a novel method of making an electrode coil for a HID lamp including the steps of closely wrapping a first wire around a mandrel in a first direction to form a first coil with a helical groove on an exterior surface, closely wrapping a second wire in the first direction in the helical groove to form a second coil, where first and last turns of the second wire touch the first and last turns of the first wire, respectively, and dissolving the mandrel and replacing it with a tungsten core so that a free end of the tungsten core is adjacent to but spaced from a corresponding end of the first coil.

Another object of the present invention is to provide a novel electrode coil for a HID lamp that avoids the problems of the prior art.

Yet another object of the present invention is to provide a novel electrode coil for a HID lamp with two overlapping wires that are wrapped in the same direction so that the second wire is entirely within a helical groove on an exterior of the first wire and in which the two coils formed by the two wires are generally the same length.

Still another object of the present invention is to provide a novel electrode coil for a HID lamp with a first wire closely wrapped in a first direction to form a first coil with a helical groove on an exterior surface, a second wire closely wrapped in the first direction in the helical groove to form a second coil, and a tungsten core with a free end adjacent to but spaced from a corresponding end of the first coil, where first and last turns of the second wire touch the first and last turns of the first wire, respectively.

DESCRIPTION OF PREFERRED EMBODIMENTS

The present invention provides a more stable layer of coils during manufacture by front winding, instead of back winding, the layers of wire. That is, two lengths of wire are wound, one atop the other, in the same direction on a mandrel. This means that the second layer of wire is entirely within a helical groove on the exterior surface of the first layer of wire. This arrangement is particularly stable and permits more rapid insertion of the shank after removal of the mandrel.

Figure 1:
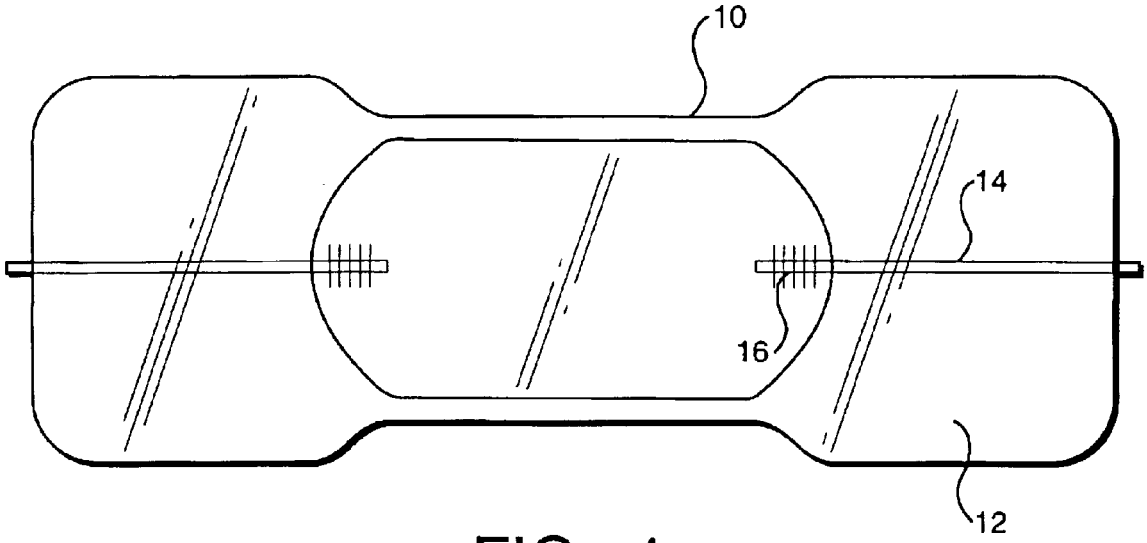
FIG. 1 PRIOR ART
FIG. 1 is partial pictorial view of a conventional HID lamp with electrode coils in opposing ends.
Figure 4:
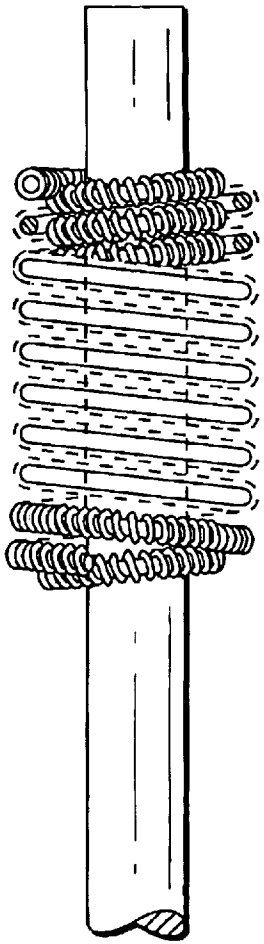
FIG. 4 PRIOR ART
FIG. 4 is a pictorial view of a known back wound, coiled coil electrode coil.
Figure 3:
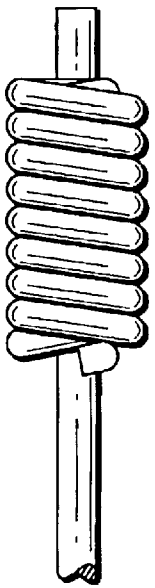
FIG. 3 PRIOR ART
FIG. 3 is a pictorial view of a conventional back wound electrode coil.
Figure 2:
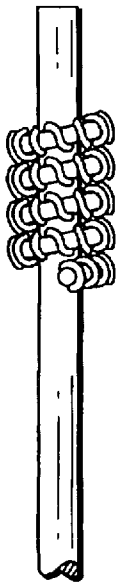
FIG. 2 PRIOR ART
FIG. 2 is a pictorial view of a conventional coiled coil electrode coil.
Figure 5:
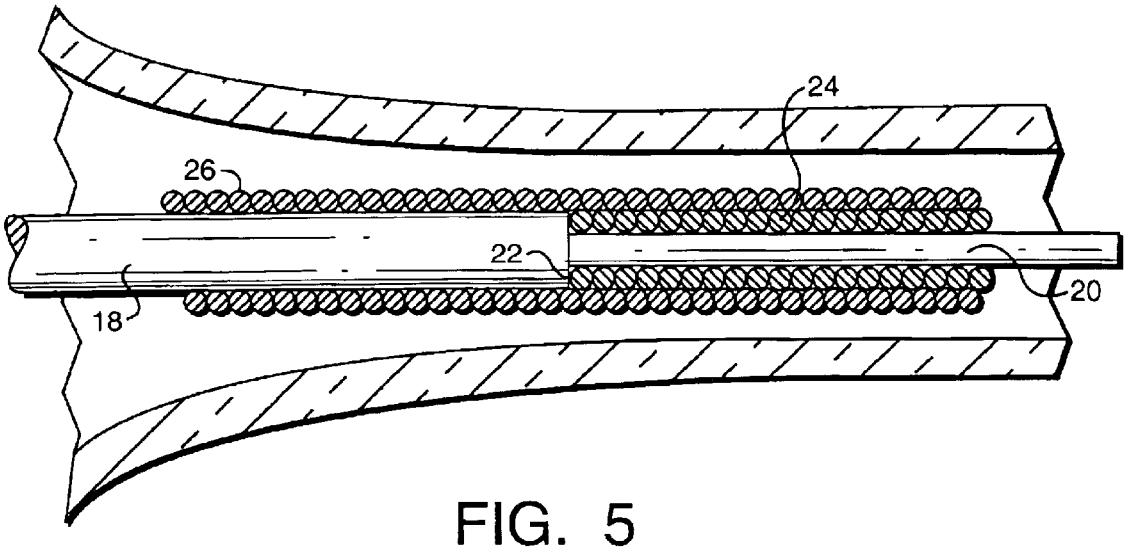
FIG. 5 PRIOR ART
FIG. 5 is a pictorial view of a known butt-weld reinforcement technique.
Figure 6:
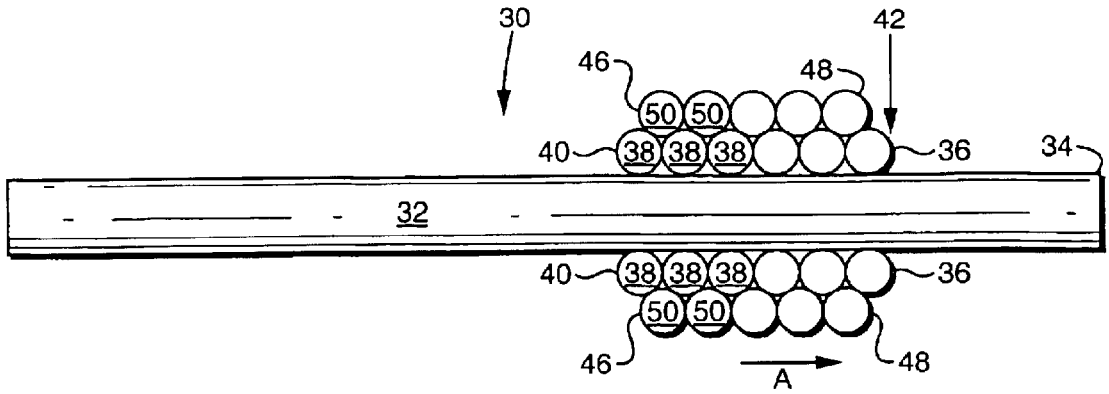
FIG. 6 is cross section of an embodiment of the electrode coil of the present invention.

With reference now to FIG. 6, an embodiment of the present invention is an electrode coil for a HID lamp. The electrode coil 30 may include a tungsten core 32 with a free end 34 adapted to be placed in a HID tube. A first wire 36 is wrapped on tungsten core 32 in a first direction (for example, left to right, as shown by direction "A" in FIG. 6) with each turn 38 of first wire 36 touching at least one other turn 38 of first wire 36. First wire 36 forms a first coil 40 that has an exterior surface with a helical groove therein. Free end 34 of tungsten core 32 is adjacent to but spaced from a corresponding end 42 of first coil 40, with an exterior of tungsten core 32 touching an interior of first coil 40. A "turn" of wire extends once around the mandrel.

A second wire 46 is wrapped in the first direction directly on first wire 36 entirely in the helical groove in the exterior of first coil 40. Second wire 46 may be second length of wire separate from first wire 36. Second wire 46 forms second coil 48 whose interior touches the exterior of first coil 40. First coil 40 and second coil 48 may have substantially the same length; that is, a first turn of second wire 46 may touch a first turn of first wire 36 and a last turn of second wire 46 may touch a last turn of first wire 36, such as shown in FIG. 6. Each turn 50 of second wire 46 may touch two turns 38 of first wire 36 and at least one other turn 50 of second wire 46.

The method of making the electrode coil of FIG. 6 may include the steps of closely wrapping first wire 36 around a mandrel (not shown, but is similar in size and shape to shank 32) in a first direction to form first coil 40 with a helical groove on an exterior surface. Thereafter, second wire 46 is closely wrapped in the first direction in the helical groove to form second coil 48, where a first turn of second wire 46 touches a first turn of first wire 36 and a last turn of second wire 46 touches a last turn of first wire 36. The mandrel is then removed and replaced with tungsten core 32 so that free end 34 of tungsten core 32 is adjacent to but spaced from corresponding end 42 of first coil 40. After wrapping second wire 46 and before replacing the mandrel, first and second coils 40 and 48 may be heat-treated, cut to a desired length, and heat-treated again.

Figure 7:
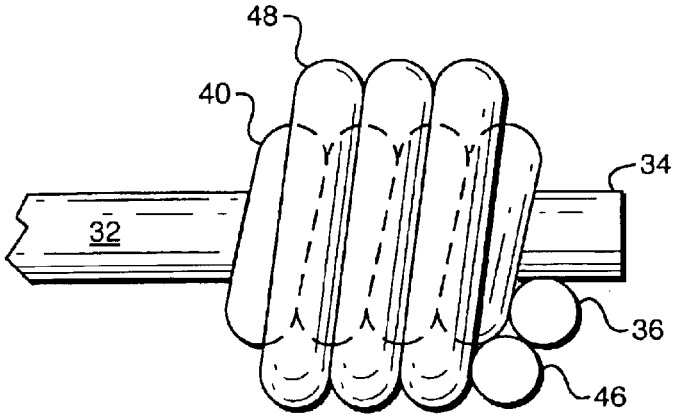
FIG. 7 is a pictorial view with phantom lines showing the coiling arrangement of an embodiment of the present invention.
Figure 8:
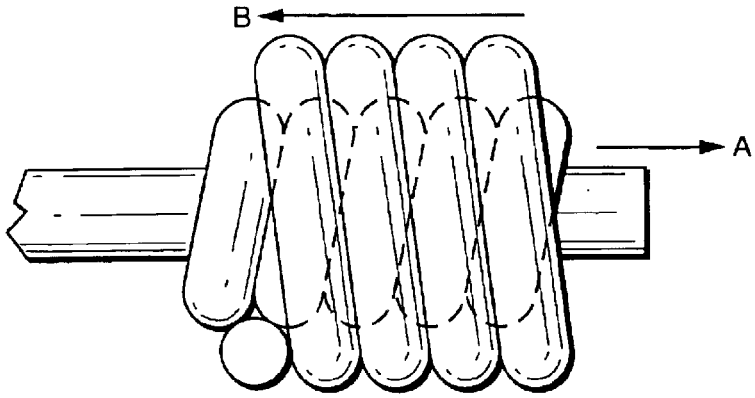
FIG. 8 PRIOR ART
FIG. 8 is a pictorial view with phantom lines showing the coiling arrangement of a known back wound electrode coil.

The result of this coiling arrangement is shown in FIG. 7. As shown therein, second coil 48 fits into the helical groove in the exterior of first coil 40 over an entire length of second coil 48. In contrast, as shown in FIG. 8, the lower layer of wire wound in direction "A" periodically is crossed by the upper layer of wire wound in direction "B" so that an entire length of the upper layer of wire is not in the helical groove in the exterior of the lower layer.

The present invention provides the advantage that the two layers of coiled wire are substantially more stable than the two layers of coiled wire in the prior art. A more stable coiled wire is easier to handle and allows the tungsten core to be more easily inserted into the position vacated by the mandrel during manufacture. This stability decreases production time and reduces the number of rejected electrode coils.

In further embodiments, second wire 46 may have the same length as the helical groove, and first and second wires 36, 46 may both be tungsten wires with the same diameter. First wire 36 may be attached to tungsten core 32 to discourage unraveling and second wire 46 may be attached to first wire 36 for the same purpose. The ends of the first and second wires may be flattened. The mandrel may be removed conventionally, such as by dissolving in acid.

While embodiments of the present invention have been described in the foregoing specification and drawings, it is to be understood that the present invention is defined by the following claims when read in light of the specification and drawings.

We claim:

1. An electrode coil for a HID lamp, comprising:

a tungsten core with a free end adapted to be placed in a HID tube;

a first coil on said tungsten core, said first coil comprising a first wire wrapped in a first direction with each turn of said first wire touching another turn of said first wire, said first coil having an exterior surface with a helical groove therein, said free end of said tungsten core being adjacent to but spaced from a corresponding end of said first coil, an exterior of said tungsten core touching an interior of said first coil; and a second coil on said first coil, said second coil comprising a second wire wrapped in the first direction directly on said first wire in said helical groove whereby the interior of said second coil touches the exterior of said first coil, a first turn of said second wire touching a first turn of said first wire and a last turn of said second wire touching a last turn of said first wire, each turn of said second wire touching two turns of said first wire 36.

2. The electrode of claim 1, wherein said second wire is the same length as said helical groove and entirely within said helical groove.

3. The electrode of claim 1, wherein said first wire is affixed to said tungsten core and said second wire is affixed to said first wire.

4. The electrode of claim 1, wherein each turn of said second wire touches another turn of said second wire.

5. The electrode of claim 1, wherein said first and second wires comprise tungsten wires with the same diameter.

* * * * *